US007342161B1

(12) United States Patent
Fox

(10) Patent No.: US 7,342,161 B1
(45) Date of Patent: Mar. 11, 2008

(54) TONALLY IMPROVED HOLLOW BODY STRINGED INSTRUMENT

(76) Inventor: Charles Edward Fox, 2745 SW. Scenic Dr., Portland, OR (US) 97225

( * ) Notice: Subject to any disclaimer, the term of this patent is extended or adjusted under 35 U.S.C. 154(b) by 0 days.

(21) Appl. No.: 11/198,791

(22) Filed: Aug. 5, 2005

(51) Int. Cl.
*G10D 3/00* (2006.01)

(52) U.S. Cl. ..... 84/290; 84/193

(58) Field of Classification Search ..... 84/290, 84/291, 267, 193, 173; D17/14
See application file for complete search history.

(56) References Cited

U.S. PATENT DOCUMENTS 3,974,730 A * 8/1976 Adams, Jr. ..... 84/291
5,469,769 A * 11/1995 Sawada et al. ..... 84/193
6,107,552 A * 8/2000 Coomar et al. ..... 84/291
6,639,135 B1 * 10/2003 Lucas ..... 84/291
6,770,804 B2 * 8/2004 Schleske ..... 84/290
6,822,147 B2 * 11/2004 McPherson ..... 84/291
2005/0252363 A1 * 11/2005 Rockett ..... 84/723

* cited by examiner

*Primary Examiner*—Lincoln Donovan
*Assistant Examiner*—Jianchun Qin
(74) *Attorney, Agent, or Firm*—Mark S. Hubert

(57) ABSTRACT

The present invention is a hollow body stringed musical instrument that utilizes a low mass, soundboard having a 12 foot radius dome configuration. The soundboard is made of a three ply torsion box design utilizing a honeycomb substrate as the central core. Linear adjustable tuning braces are incorporated in the hollow body. The side and back of the instrument are also of a three ply construction having a closed cell, resilient polymer foam as the central layer. All structural braces are eliminated from the interior of the instrument's body.

11 Claims, 7 Drawing Sheets

(SECTION A–A)

(SECTION A–A)

TONALLY IMPROVED HOLLOW BODY STRINGED INSTRUMENT

BACKGROUND OF THE INVENTION

The guitar, in one form or another, is one of the most popular musical instruments in use today and is used in a plethora of musical genres. The "voice" any particular guitar has is based on its design and construction. The present invention relates to a steel string acoustic (hollow body) guitar that gets its strength and tonal quality from the incorporation of various unique structural design elements in the guitar's body, particularly, from the from the use of a laminated, domed top and tunable braces the stringed musical instrument's soundboard.

Luthiers strive to produce the best sounding guitars that they can. To accomplish this they must build guitars that emanate tones (notes) pleasant to the ear, and that produce maximum sound amplification. Sound is any change in air pressure that our ears can perceive. Pleasant sound, is generally known as the tones or notes of the major and minor scales. These notes are denoted by the frequency of oscillation that causes the change in air pressure that our ears perceive as that note.

A tonal quality is distinguished as clear (or "true") when the ear perceives a solo frequency of oscillation or a combination of a very small number of related frequencies of oscillation (harmonics) rather than a combination of hundreds of random frequencies of oscillation. Although the generation of good tonal quality is a function of several elements such as the materials of construction, the volume, the shape and taper of the body as well as the configuration of the upper and lower bouts, primarily good tonal quality is accomplished by a soundboard that produces a minimal number of random frequencies of oscillation. To do this the soundboard must undergo very little localized distortion so that it can vibrate uniformly across it's entire surface. Accomplishing this requires the soundboard to be uniformly rigid. Since the soundboard (guitar top) is only secured to the sides about it's periphery, the central region about the sound hole is free to distort and flex more than the periphery. Additionally, the six strings on an acoustic guitar impart between 90 to 200 pounds of angled tension upon the bridge which place further distortion forces on the soundboard's central region. The prior art traditionally has installed stiffening or strengthening braces on the underside of the top to account for this.

This new guitar structural design utilizes a stronger, more uniform soundboard through the incorporation of a laminated honeycomb torsion box construction in conjunction with a domed top. This rigid design eliminates the need for such braces in the lower bout and upper bout of the guitar top.

In a different foam laminated design, the back of the guitar and the sides have been made thicker and stronger but lighter thereby eliminating the need for back and side structural braces.

It is known that the tonal quality of a soundboard also changes with age. Since this cannot be adjusted once the guitar has been constructed, another way to improve tonal quality is by "tweeking" or fine adjusting of the soundboard (or bottom) by the use of adjustable braces strategically placed on the underside of the soundboard or back of the guitar. These can be used to compensate for other elements that affect tonal quality such as design inadequacies, temperature and humidity. Since the body of a guitar favors some frequencies (amplifies them better) and discriminates against others (does not amplify them as well), tweeking the guitar by using the adjustable braces allows the tuner to optimize the tonal quality of the guitar for the changing circumstances.

It is known that the tonal quality of a stringed instrument changes with time. Continuous vibrations as those experienced with regular use of a musical instrument changes the nature and resonance of the wood. (The molecular bonds of wood actually break because of vibration and that this what affects the tonal qualities.) This results in a change in the stiffness of the soundboard and a decrease in the dampening coefficient, (a measure of cycles of vibrations emanating from the material). Lower damping coefficients mean that a single note is heard longer, which is considered a beneficial attribute. Both factors are known to help provide more pleasant tones in spruce, mature pine and other woods used in instrument sounding boards. With tuneable braces this improved sound can be accomplished earlier.

Henceforth, a guitar body with a minimal number of braces especially in the lower bout region, would fulfill the long felt need in the stringed instrument industry. This new invention utilizes and combines both known and new technologies in a unique and novel configuration to overcome the aforementioned problems of the prior art.

SUMMARY OF THE INVENTION

The general purpose of the present invention, which will be described subsequently in greater detail, is to provide a hollow body guitar that is able to produce a loud, "true" sound (one with superior tonal quality) having a shortened response or "lag" time between manipulation of the strings and the production of sound.

It has many of the advantages mentioned heretofore and many novel features that result in a new improved guitar which is not anticipated, rendered obvious, suggested, or even implied by any of the prior art, either alone or in any combination thereof.

In accordance with the invention, an object of the present invention is to provide an improved soundboard for a hollow body guitar capable of retaining its configuration without the use of braces.

It is another object of this invention to provide an improved soundboard for a stringed instrument that is tunable through the use of adjustable braces.

It is a further object of this invention to provide a hollow body guitar top having reduced mass that allows for the rapid transmission of sound capable of meeting or exceeding current industry standards.

It is still a further object of this invention to provide for a steel string hollow body guitar soundboard that has enhanced strength with a minimal mass.

It is yet a further object of this invention to provide for a steel string hollow body guitar back and side that has enhanced strength with reduced mass and no structural braces.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 16 is a cross sectional view of the preferred embodiment of the guitar taken through section A-A of FIG. 1.

DETAILED DESCRIPTION

Figure 2:
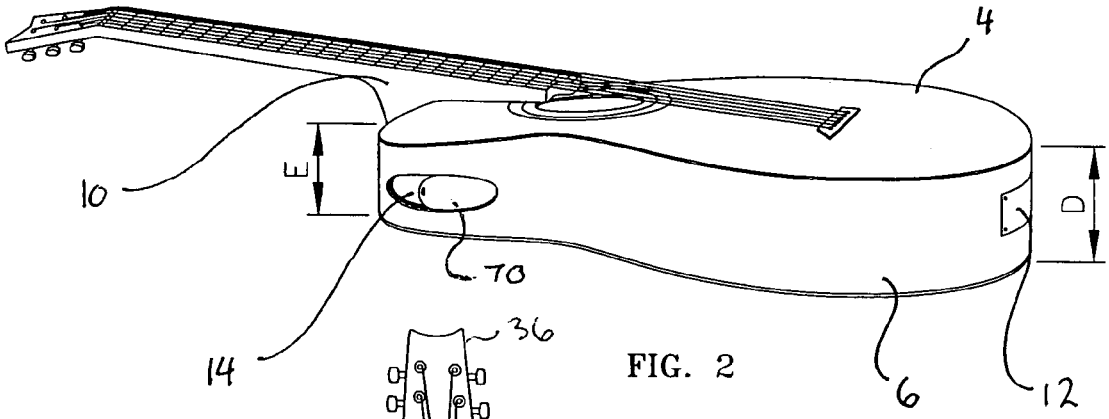
FIG. 2 is a top view of the preferred embodiment guitar.

The present invention provides a novel guitar configuration that has improved tonal quality, volume and response time for a steel six-string hollow body acoustic guitar. There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. More particularly, elements of this invention may be utilized by other hollow body stringed instruments such as mandolins, sitars, violins, violas, cellos, ukeleles, etc. Further, although discussed with regard to a steel six-string hollow body acoustic guitar, the novel and inventive elements discussed herein may be utilized with similar steel twelve-string guitars and nylon string guitars. Also, it is to be understood that the phraseology and terminology employed herein are for the purpose of descriptions and should not be regarded as limiting.

For a thorough understanding of the importance and novelty of this invention, one must first understand how an acoustic guitar works. An acoustic generates its sound in the following way: when the strings on a guitar vibrate, they transmit their vibrations to the saddle/bridge combination; the saddle transmits its vibrations to the soundboard; the soundboard vibrates both projecting the amplified sound off of it's generally planar surface, and pumping air (and thus sound) from inside the hollow body, out through the sound hole. (Only about 10% of the sound comes from the sound hole.)

The volume and response time of the guitar is a function of the speed and magnitude of vibration that the soundboard can develop. Thus, the entire key to achieving volume and a quick response time from the soundboard is to reduce its mass (so the string energy is not wasted by moving a heavy soundboard), and to maximize it's flexibility. Keeping in mind that the tension on the guitar's soundboard varies from 90 to over 200 pounds force, the top must be resilient enough to withstand this force without pulling apart. To date, the prior art has overcome this obstacle by installing braces on the soundboard's inner surface. This, in turn, causes tonal distortion and only partially solves the problem since it still adds mass to the soundboard. The key to good tonal quality is to reduce the localized regions of stiffness across the guitar top introduced by structural braces.

The present invention renders a light, responsive soundboard. It has less mass due to it's laminated, torsion box soundboard and the elimination of structural braces. The other elements incorporated into the various embodiments improve the tonal quality of the guitar or the ergonomics for the guitarist.

Figure 7:
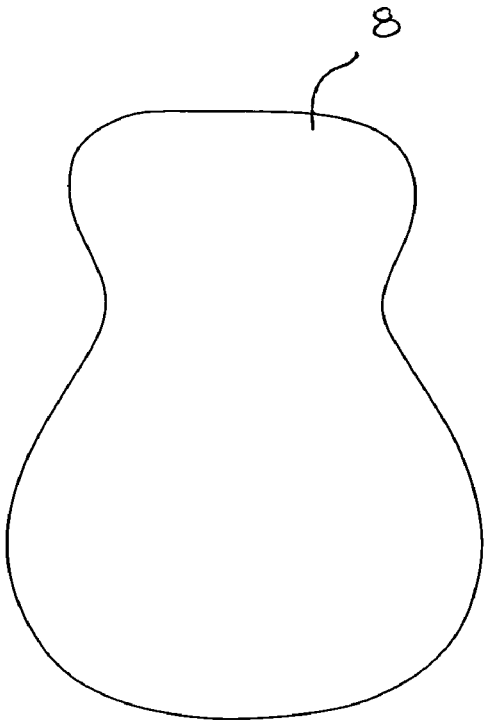
FIG. 7 is a view of the inner side of the preferred embodiment guitar back without structural braces.

The present invention relates to an improved steel string, hollow body acoustic guitar. Looking at FIGS. 1 and 2 it can be seen that the guitar 2 has a domed top (soundboard) 4, a domed back 8 (See FIG. 7), a tapered side wall 6 substantially normal and connected to both the back 8 and the soundboard 4, an elevated neck 10, an access panel 12, an adjustable sound port 14, a sound hole 16, a bridge 18, a saddle 20, strings 24, frets 26, a head 36, nut 34 and tuning pegs 28. The body of most acoustic guitars has a "waist," or a narrowing 22 located about the centerline of the sound hole 16, to make it easy to rest the guitar on a knee. The two widenings are called bouts. The upper bout 30 is where the neck 10 connects, and the lower bout 32 is where the bridge attaches. The lower bout 32 accentuates lower tones and the upper bout 30 accentuates higher tones. Finally, between the neck 10 and the head 36 is a piece called the nut 34, which is grooved to accept the strings.

The invention is best described by addressing its individual elements and features separately.

The Soundboard

Figure 3:
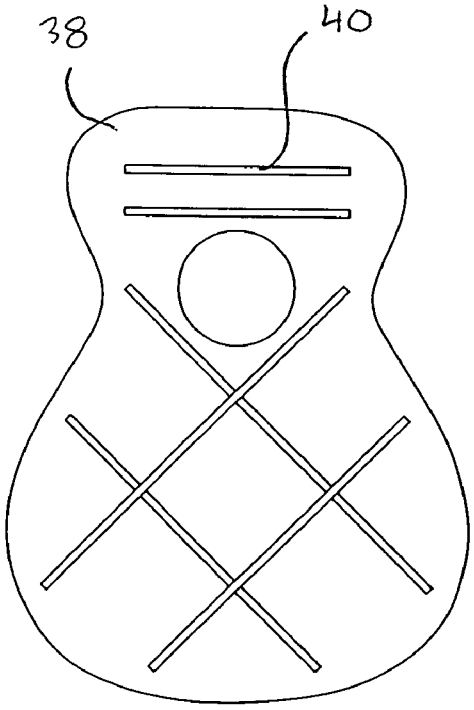
FIG. 3 is a view of the inner side of a guitar back showing one possible brace configuration.

FIG. 3 illustrates the inner surface of the soundboard of a conventional guitar 38. Structural braces 40 are generally placed across the upper bout region 30 to strengthen the area where the neck 10 connects to the guitar body. Similarly, structural braces are placed in a pattern strengthening the area of the lower bout 32 that lies directly below where the bridge 18 attaches to the soundboard 4. These braces 40 although introducing patterns of stiffness to the soundboard, are necessary to reinforce and strengthen the thin soundboard 4 so it will not pull apart or distort from the stresses introduced at the neck 10 and bridge 18. The present invention eliminates structural braces 40.

Figure 9:
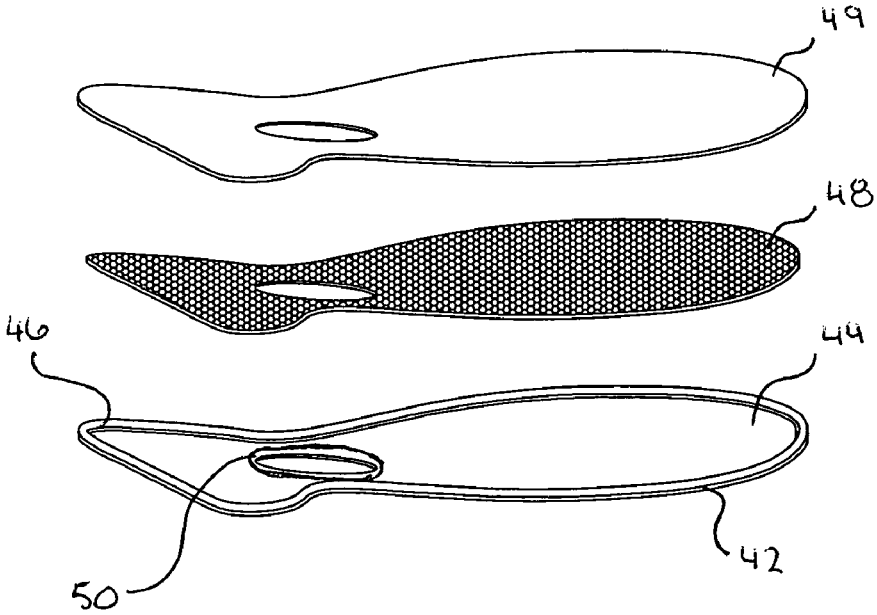
FIG. 9 is an exploded illustration of the preferred embodiment soundboard.

Looking at FIG. 9, although illustrated upside down, the general laminated three ply construction of this invention's soundboard 4 can best be seen. Top skin 42 is made from any of a variety of woods selected for it's appearance, flexibility, strength and tonal characteristics, such as spruce or cedar. The thickness of top skin 42 is approximately 0.090 of an inch thick. The interior region of top skin 42 has been removed to a depth of approximately 0.060 of an inch to create laminate depression 44 except for a ⅝ inch wide continuous flange, thick about the perimeter of the skin 42 and a 1 and ¼ inch wide substantially similar second raised flange 50 about the sound hole 16 periphery.

The middle ply is a sheet of continuous hexagonal cell shapes know in the industry as a honeycomb core 48 that has been configured to match the depth and contours of laminate depression 44. Honeycomb cores are available in a variety of materials for sandwich structures. Here honeycomb Nomex® is used as the central layer to form a torsion box configuration. Although Nomex® honeycomb is used as the honeycomb of the core, there are a plethora of alternate products such as ABS, Polycarbonate, Polypropylene, or Polyethylene that would suffice. Nomex® honeycomb is made from Nomex® paper—a form of paper based on Kevlar®, rather than cellulose fibers. The initial paper honeycomb is an inert aramid reinforced fibre (basically a fiberglass composite) that is dipped in a phenolic resin to produce a honeycomb core with high mechanical properties, low density and good long-term stability.

The honeycomb core 48 is used not solely because of it's light weight, high strength and stiffness, but because it can be processed into both flat and curved composite structures, and can be made to conform to compound curves (such as is found in the domed guitar soundboard 4) without excessive mechanical force or heating.

Honeycomb core 48 is epoxied into laminate depression 44 of top skin 42 and the assembly is weighted and placed into a dished mold having a 12 foot circular radius. (Reference the alternate embodiment illustrated in FIG. 5) Honeycomb cores can give stiff and very light laminates but due to their very small bonding area they are almost exclusively used with high-performance resin systems such as epoxies so that the necessary adhesion to the laminate skins can be achieved.

The third ply (inner skin) 49 is a 0.060 of an inch thick, generally planar sheet of wood. The exposed honeycomb core 48 is epoxied to the third ply 49 and the three ply assembly 4 is weighted and placed in the dished mold. It is to be noted that the grain of inner skin 49 is laid up perpendicular to the grain of top skin 42 to add dimensional stability and strength. The addition of the honeycomb core increases the relative stiffness of the soundboard 4 approximately 7 times, increases the strength approximately 3.5 times while only marginally increasing the weight by about 3%.

The soundboard 4 while appearing to be generally planar, has a slight curvature with a radius of between 12-15 feet with the preferred embodiment being 12 feet. This radius is a severe radius in the world of guitar soundboards whereas conventional soundboards have radius's of 25 feet or greater. This prestressing further increases the strength of the soundboard 4. There is a careful balance between the reduction in mass and the increase in stiffness of the soundboard 4. The abovementioned configuration of a domed, three ply, torsion box soundboard 4 with removed structural braces 40 gives the guitar a tonally improved "voice", a lower mass (quicker response) and enhanced vibrational response (louder volume) as compared to a conventional guitar.

Figure 4:
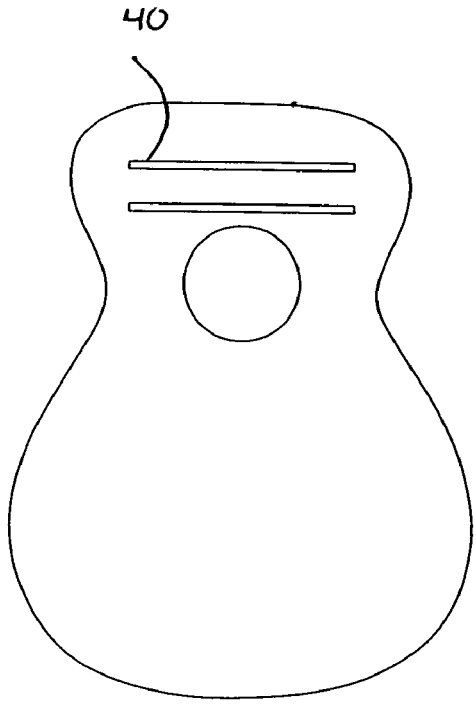
FIG. 4 is a view of the inner side of a guitar back showing a second possible brace configuration in the upper bout region.
Figure 6:
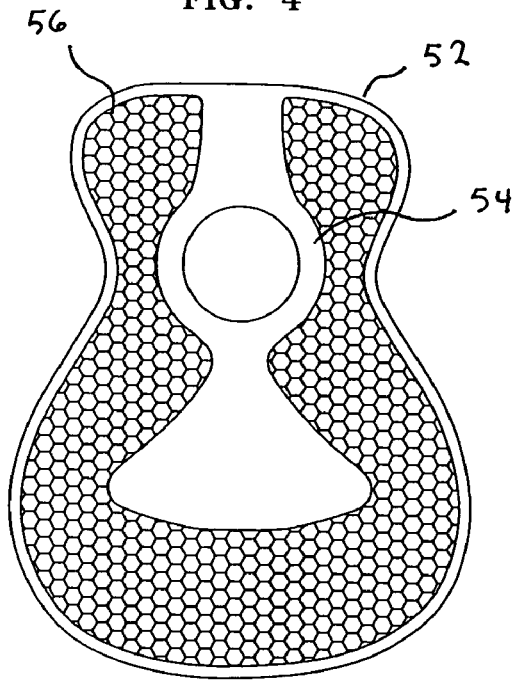
FIG. 6 is a view of the inner side of a soundboard outer skin with the honeycomb residing in it's patterned depressed region.

Looking at FIG. 6 the preferred embodiment of the soundboard 4 is illustrated. Preferred top skin 52 has larger flange 54 that spans the regions directly below where the neck 10 attaches and where the bridge 18 attaches on the other side of the skin 52. The preferred honeycomb core 56 is correspondingly configured. This gives a larger glueing surface since the third ply 40 would be directly laminated to the top skin 52 in these regions. This gives extra strength to prevent delaminating of the Honeycomb core 48 from either or both of the other skins under the mechanical load imposed by the tension of the strings 24 onto the neck 10 and the bridge 18. In this embodiment the third ply 49 is unchanged. The soundboard is laid up in a 12 foot radius dome. In this embodiment structural braces are only used on the underside of the soundboard 4 in the region of the upper bout 30. (Reference FIG. 4) The soundboard 4 is top sanded removing material such that the overall thickness of the soundboard 4 is about 0.140 of an inch thick.

The Back

Figure 8:
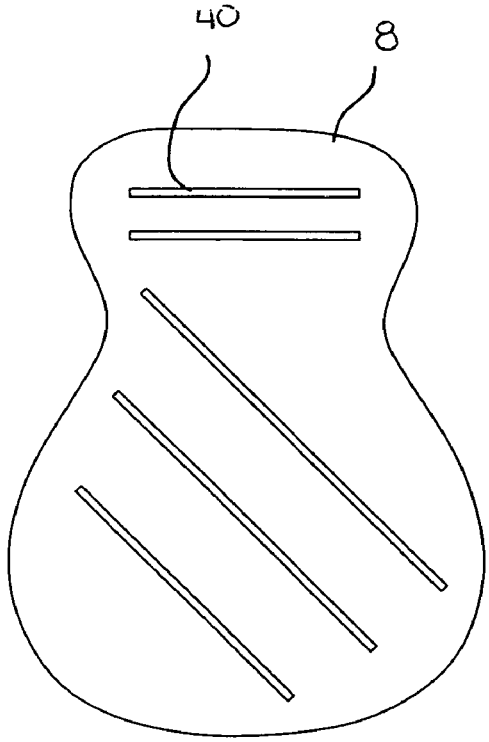
FIG. 8 is a view of the inner side of an alternate embodiment guitar back with structural braces.
Figure 13:
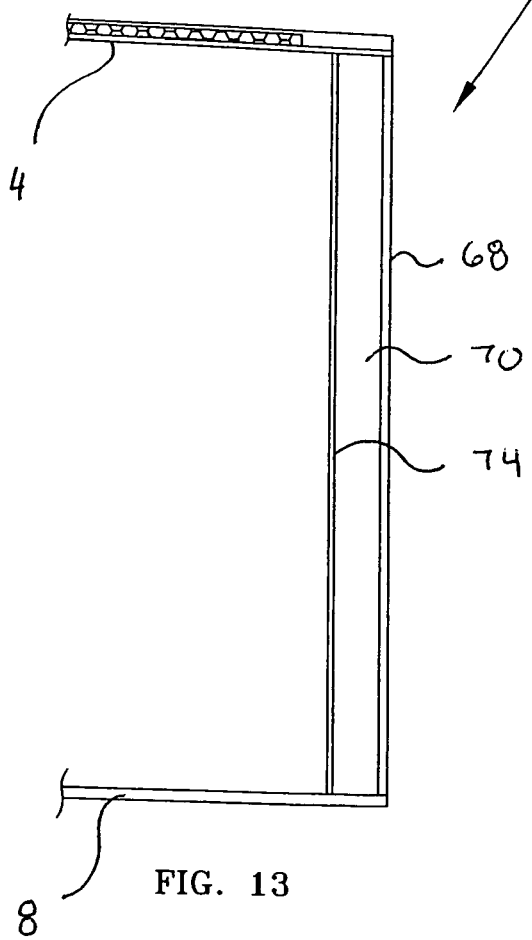
FIG. 13 is an enlarged view of the right side of FIG. 12.

Referring to FIGS. 8 and 13, a conventional guitar back 8 has been illustrated. Structural braces 40 are placed in a configuration as dictated by that particular Luthier. The back 8 is generally made of a wood, however, composite substrates are also commonly used. In the preferred embodiment the guitar back 8 is approximately 0.090 of an inch thick and also has a domed configuration having a 12 to 14 foot radius substantially similar to that of the preferred embodiment soundboard 52.

Figure 10:
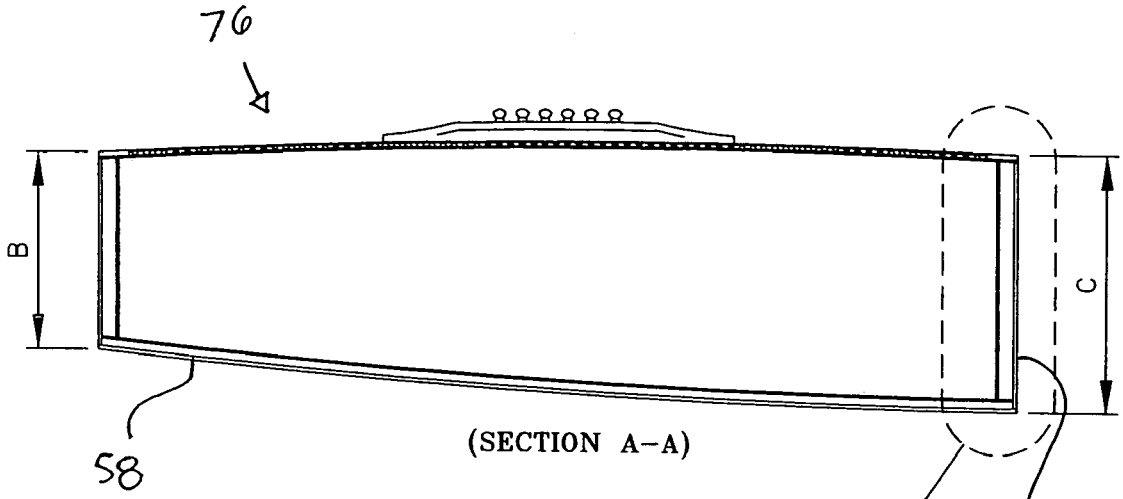
FIG. 10 is a cross sectional view of the alternate embodiment of the guitar taken through section A-A of FIG. 1.
Figure 11:
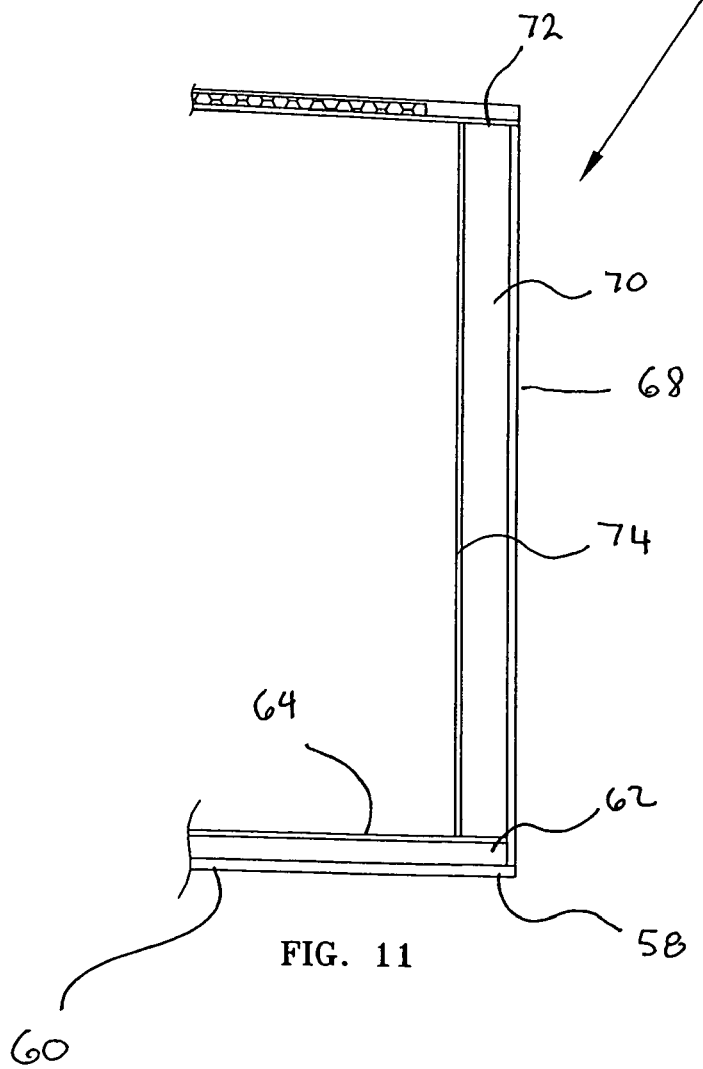
FIG. 11 is an enlarged view of the right side of FIG. 10.
Figure 12:
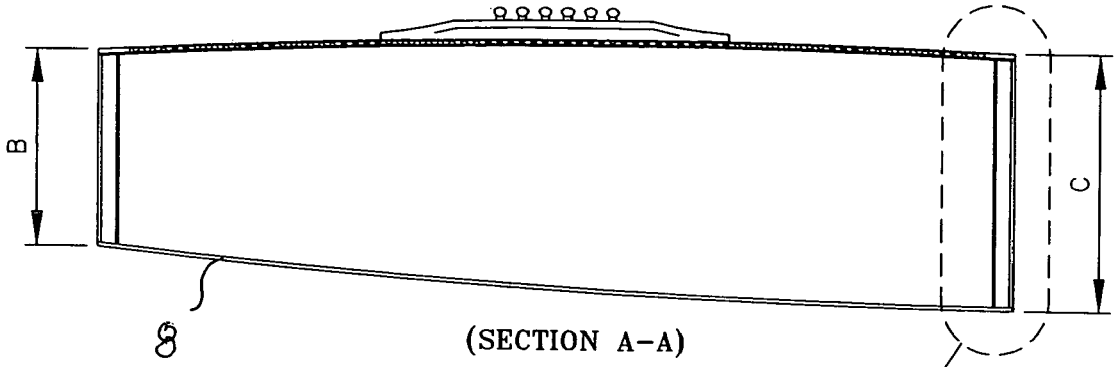
FIG. 12 is a cross sectional view of the preferred embodiment of the guitar taken through section A-A of FIG. 1.

FIGS. 10 and 11 show the alternate embodiment back 58. It is of a three ply construction, where in the outer skin 60 is 0.050 of an inch thick wood, the middle ply 62 is a 0.125 of an inch thick resilient closed cell, heat formable polymer foam, and the inner skin 64 is a 0.031 of an inch thick three ply plywood. A suitable adhesive is used to bond the plies together. This type of construction in the alternate embodiment back 58 offers increased strength and rigidity with reduced weight and simplifies the formation of the domed configuration. While traditionally made from wood, the outer skin 60 and the inner skin 64 may be replaced by thinner polymer or composite materials such as composite graphite. With such substitution it is expected that the outer skin 60 and inner skin 64, may approach 0.003 of an inch thick.

The Side

Figure 1:
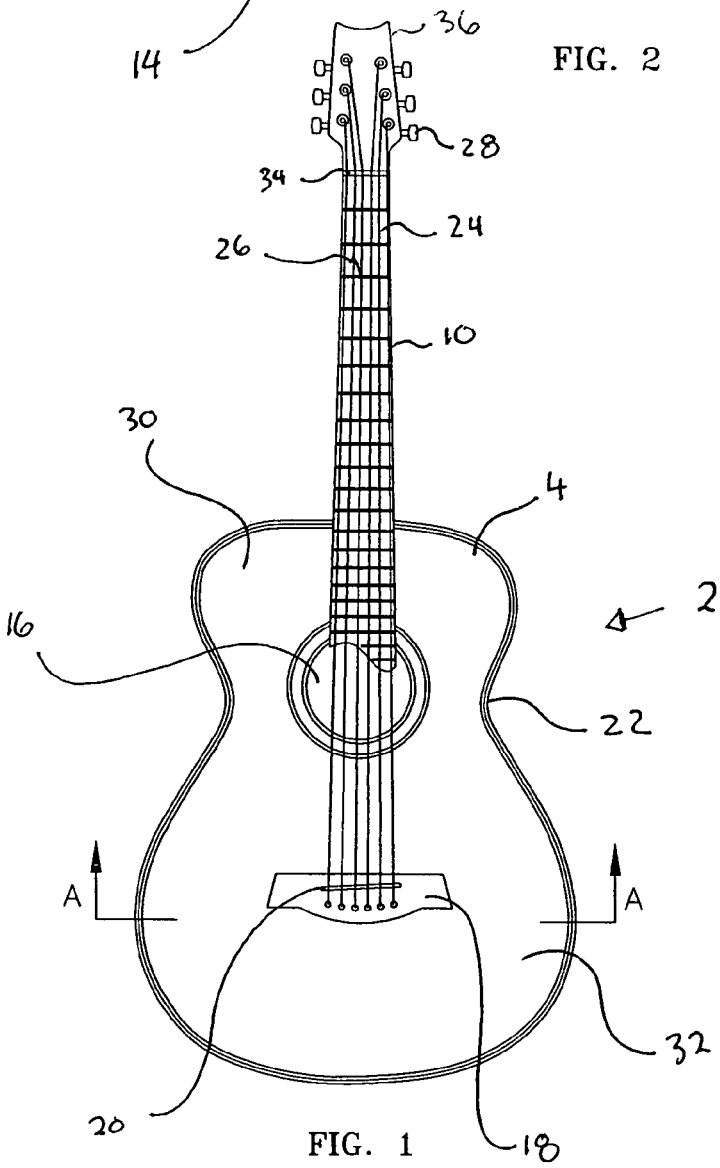
FIG. 1 is an angled side perspective view of the preferred embodiment guitar.

Referring to FIGS. 1, 6 and 17 the preferred embodiment of guitar side 6 can best be seen. The side 6 is generally made from wood having a thickness of approximately 0.090 of an inch. Similar to the back, polymer or composite materials of reduced thickness may be substituted for the wood. The side 6 is attached to the soundboard 4 and the back 8 by adhesive fixation to corner brace 66. An adjustable sound port 14 is located above the waste 22 in the upper bout 30 region. It is of a generally electrical configuration and has a slidable door 70. Fabrication and assembly of such would be well known by one skilled in the art. The adjustable port 14 allows some of the sound generated within the hollow body to be directed to the guitarist's ear. A curved removable access panel 12 is located in the lower bout 32 region in line with the horizontal axis of the neck 10. The internal region of the hollow body guitar may be accessed by removal of mechanical fasteners used to secure the access panel 12. The detailed configuration of the adjustable sound port 14 slidable door 70 and access panel 12 would be well-known to one skilled in the art.

FIGS. 10 and 11 illustrate an alternate embodiment side 68. The alternate embodiment uses a three ply construction substantially similar to that of alternate embodiment back 58, except that the resilient closed cell, heat formable polymer foam side middle ply 78 is 0.250 of an inch thick. This allows for a larger adhesive surface 72, between the alternate embodiment side 68 and whichever configuration of guitar soundboard and back are utilized. This enhanced adhesive surface eliminates the need for side braces 66, therein reducing mass and unwanted patterns of stiffness. The side and inner ply 74 is of 0.030 of an inch thick three ply plywood. Since the middle ply 78, is heat formable this type of construction simplifies the formation of the side contours about the waste 22 lower bout 32 and upper bout 30.

The Neck

Referring now to FIG. 2 it can be seen that neck 10 has an elevated profile above soundboard 4 in the upper bout 30 region. This raised profile increases, the acute angle between guitar strings 24 and bridge 18. This changes slightly, the angle of tension, from which the guitar strings 24 pull on the domed soundboard 4, helping maintain the severe 12 foot radius dome of the soundboard 4.

In the preferred embodiment, the upper region of the neck 10 has a very slight taper perpendicular to its longitudinal axis to relieve the guitarist's wrist strain The Guitar Body Referring to FIGS. 2 and 10, the overall shape of the guitar body can be seen. The guitar body 76 is made of the assembled soundboard 4, side 6 and back 8. The guitar body's longitudinal axis is aligned with the longitudinal axis of the neck 10. The depth of the lower bout 32, indicated by dimensional line D is greater than the depth of the upper bout 30 indicated by dimensional line E. This gives guitar body 76, a gradual downward first taper approaching the neck 10. Looking at the cross-sectional section of guitar body 76 taken perpendicular to its longitudinal axis, it can be seen that the depth of one side indicated by dimensional line C is greater than the depth of the other side indicated by dimensional line B. (Because there are right hand guitars and left hand guitars the sides are not specified.) This forms a second taper in guitar body 76 perpendicular to the first taper, resulting in an over all guitar body appearance of a tapered wedge. Conventional guitars lack the second taper. The second taper is a purely economic feature and allows the guitar body 76 to angle up towards the guitarist while resting upon his knee, thereby reducing wrist strain and allowing the guitarist to better see his string and finger positioning. (Not illustrated)

Tuneable Braces

Figure 14:
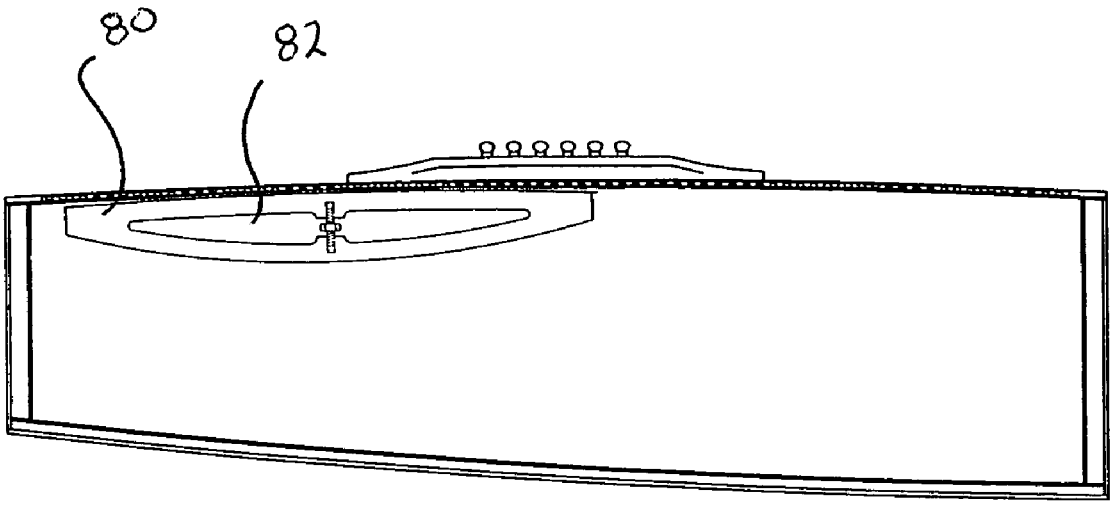
FIG. 14 is a side view of a tunable brace installed in a cut away guitar.
Figure 15:
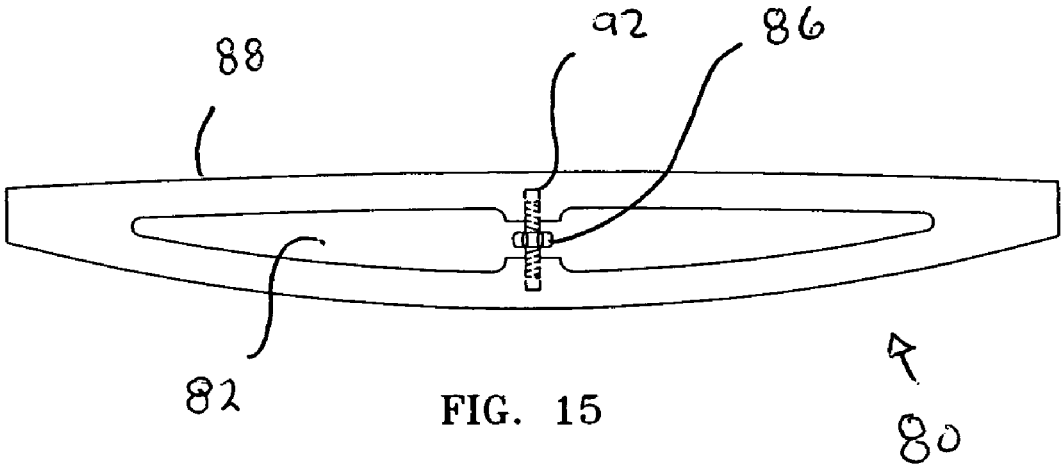
FIG. 15 is side view of a tuneable brace.
Figure 1B:
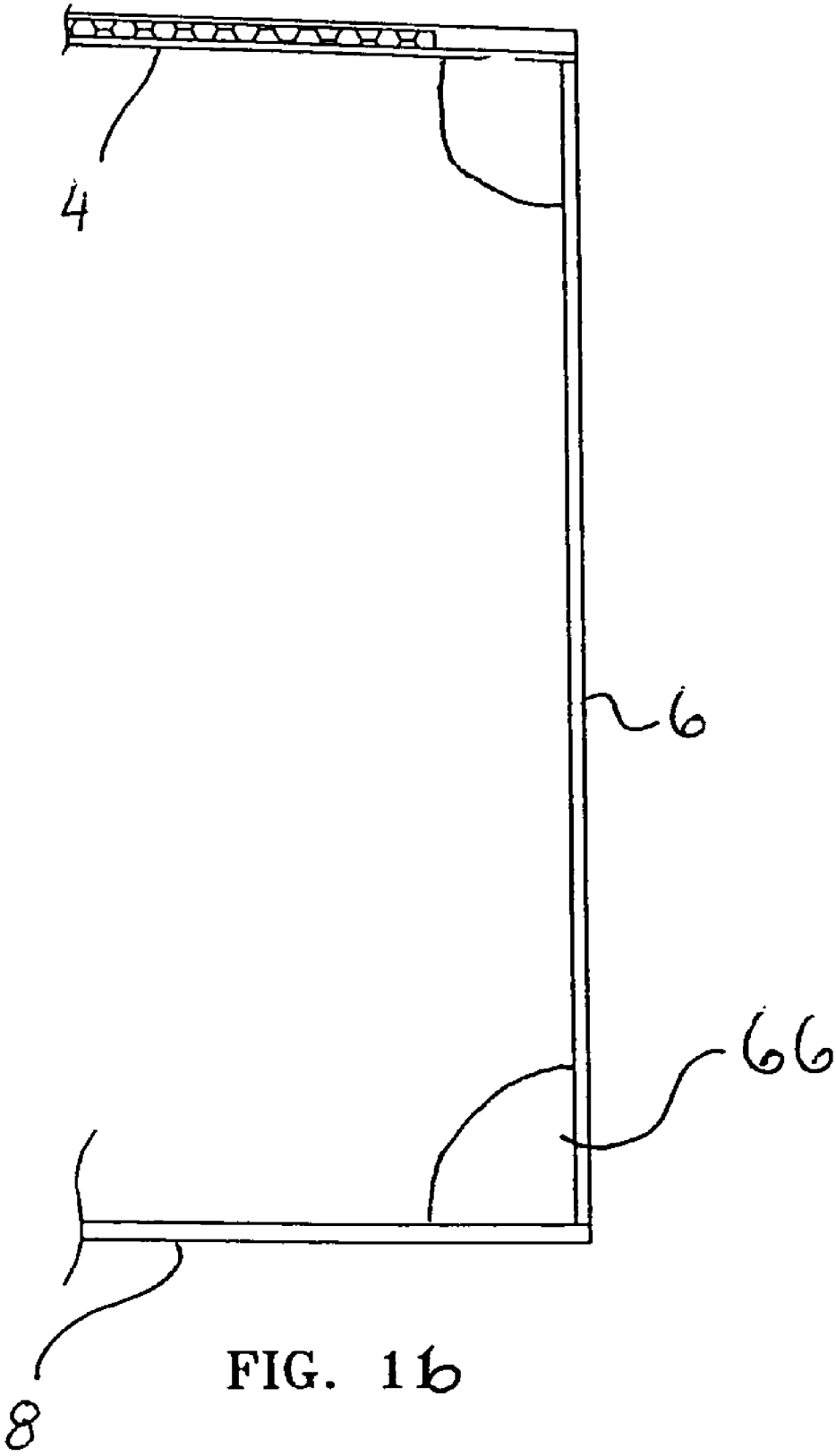

A tuneable brace is a thin, lightweight, linear member that can be affixed anywhere to the inner side of a soundboard or guitar back that can be stiffened or relaxed to add patterns of wanted stiffness to the guitar body to compensate for tonal distortions in the guitar. Referring to FIGS. 14 and 15 it can be see that tunable brace 80 is a generally elliptical shaped member with a configured, cutout center 82. Only one of the sides is affixed to the guitar. The outer curvature of the guitar side 88 fully or partial corresponds to the radius of the guitar domed soundboard or back. The opposing floating side 90 of this member and the guitar side 88 are each threadingly engaged at threaded recesses 92 with a central adjustable thumbscrew 86 that can be adjusted to place these opposing sides in various levels of tension or compression with respect to each other to stiffen or relax the brace 80. The tunable braces 80 may be incorporated into any of the various embodiments. It is constructed from wood or a lightweight polymer. The size of the tuneable brace may be varied as well as the number and placement of the tuneable braces. Each guitar must be tuned as per the Luthier's specific desires.

THE PREFERRED EMBODIMENT

The preferred embodiment of the total improved hollow body stringed instrument is a steel, six string, hollow body, acoustic guitar 2 as shown in FIG. 2. It's soundboard 4 is of a three ply, torsion box 12 foot radius domed configuration as seen in FIG. 6. There are no structural braces 40 on the soundboard 4 in the lower bout 32 region. There are structural braces 40 on the soundboard in the upper bout 30 region beneath, where the neck 10 attaches to the guitar body. The side 6 and back 8 are as illustrated in FIG. 17. They are both of a single ply wood construction adhesively connected by braces 66. The back 8 is domed in the 12 foot radius and has structural braces 40 mounted thereon, as shown in FIG. 8. The actual placement of braces 40 upon back 8 will vary with the Luthier. The preferred embodiment will have an adjustable sound port 14, removable access panel 12 and a raised profile design neck 10.

THE ALTERNATE EMBODIMENT

Figure 5:
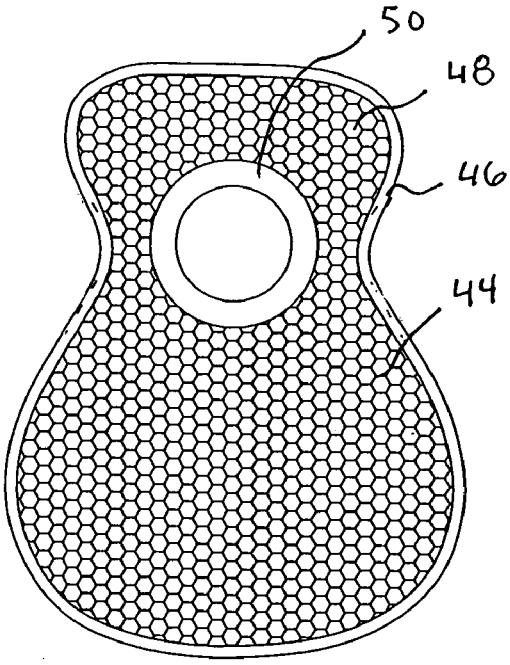
FIG. 5 is a view of the inner side of a soundboard outer skin with the honeycomb residing in it's depressed region.

The alternate embodiment of the total improved hollow body stringed instrument is a steel, six string, hollow body, acoustic guitar having a soundboard 46 of a three ply, torsion box 12 foot radius domed configuration as seen in FIG. 5 with two separate flanges. The soundboard will have no structural braces 40 thereon. The alternate embodiment side 68 will be of a three ply construction utilizing the 0.250 of an inch closed cell foam as illustrated in FIG. 11. The alternate embodiment back 58 will also be of a domed 12 foot radius three ply construction utilizing the 0.125 of an inch closed cell foam. The inside of back 58 will have no structural braces 40. There will be no structural braces 40, attaching back 58 to side 68 to soundboard 4. The remainder of the guitar, including the adjustable sound port 14, removable access panel 12 and raised profile neck 10 will remain substantially similar to that of the preferred embodiment.

There is another alternate embodiment of this guitar that has not been illustrated. The fundamental differences between these alternate embodiments is that the outer skins and or inner skins of the three ply construction of the soundboard, side and back are not made of wood, but rather an extremely thin carbon fiber composite in the range of 0.003 to 0.015 of an inch thick.

It will be noted that all of the dimensions noted herein are with reference to a specific guitar and as such may deviate up to 100% in the dimensional tolerances. This is especially true in light of the thickness of the materials utilized.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. For example, the cells of the honeycomb core can also be filled with a rigid foam to provide a greater bond area for the skins, and increase the mechanical properties of the core by stabilizing the cell walls and increasing thermal and acoustic insulation properties. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A hollow body stringed musical instrument comprising: strings;

a hollow body having a two and three layer constructed soundboard having a generally uniform thickness planar configuration with a sound orifice defined therethrough, affixed generally perpendicular to a side, which is affixed generally perpendicular to a back where said side maintains said back and said soundboard in a spaced relationship;

a neck with a fretboard, a head, a nut, and string tuning pegs thereon; and a bridge assembly of a bridge, saddle and string retention pegs; wherein said neck is affixed to said body so as to form a common longitudinal axis, and said bridge assembly is affixed to said soundboard such that strings connected between said bridge assembly and said tuning pegs reside substantially parallel to said longitudinal axis and above said sound orifice, wherein said soundboard is constructed in an adhesively affixed, two and three layer configuration of the first, second and third layers or first and third layers, having a first layer of wood having an outer surface and an inner surface and said inner surface has a contoured depression thereon such that corresponds to a thickness and a contoured configuration of said second layer, a second layer of continuous hollow hexagonal cell shapes made from a paper product, and a third layer made of wood, such that a grain of said first layer resides with its longitudinal axis perpendicular to a grain of said third layer, and further, wherein said soundboard has a uniform thickness and is contoured about a 12 to 15 foot radius.

2. The hollow body stringed musical instrument of claim 1 wherein said side has a three ply form core construction made of a wood outer skin adhesively bonded to a closed cell polymer foam inner skin which is adhesively bonded to a wood inner skin such that a grain of said outer skin resides with its longitudinal axis perpendicular to a grain of said inner skin.

3. The hollow body stringed musical instrument of claim 2 wherein said back has a three ply form core construction made of a wood outer skin adhesively bonded to a closed cell polymer foam inner skin which is adhesively bonded to a wood inner skin.

4. The hollow body stringed musical instrument of claim 3 wherein said instrument is a steel string acoustic guitar and wherein said neck has a raised profile and wherein said side is tapered along a horizontal axis and is tapered along a lateral axis which is perpendicular to said horizontal axis, so as to form two distinct wedge configurations across said body.

5. The hollow body stringed musical instrument of claim 4 wherein said side has a generally elliptical adjustable sound port therethrough and an access orifice defined therethrough.

6. The hollow body stringed musical instrument of claim 1 wherein said back has a three ply form core construction made of a wood outer skin adhesively bonded to a closed cell polymer foam inner skin which is adhesively bonded to a wood inner skin.

7. The hollow body stringed musical instrument of claim 1 further comprising at least one tuneable brace wherein said tuneable brace is made from at least one generally linear member affixed to an inner surface of said soundboard or said back of said hollow body and is adapted for adjustable stiffening.

8. The hollow body stringed musical instrument of claim 7 wherein said tuneable brace has a first longitudinal side, a second longitudinal side, a central orifice defined therein and an adjustable tensioning mechanism adapted to draw said first side and said second side into closer proximity to each other together, therein stiffening said sides, wherein said first longitudinal side is affixed to an inner surface of said soundboard or said back.

9. The hollow body stringed musical instrument of claim 8 wherein said adjustable tensioning device is a rotatable member about a linear axis, having a first threaded end and a second threaded end, wherein said first threaded end is in threaded engagement with a first matingly threaded recess in said first side, and wherein said second threaded end is in threaded engagement with a second matingly threaded recess in said second side of said tuneable brace.

10. The hollow body stringed musical instrument of claim 8 wherein said instrument is a steel string acoustic guitar.

11. An improved hollow body, acoustic, steel stringed guitar comprising:

a two and three ply soundboard formed of an outer skin, central core and inner skin adhesively affixed together in a sandwiched configuration wherein said outer skin is of wood construction having an outer surface and an inner surface and said inner surface has a depression between a raised flange about the periphery of said soundboard, and about a raised flange around the periphery of a sound orifice defined therein said soundboard, such that said depression corresponds to a thickness and shaped configuration of said central core, and wherein said central core is a sheet of continuous hollow hexagonal cell shapes made from a reinforced fiber paper wherein said fibers are a para-aramid polymer positioned and adhesively affixed within said depression, and wherein said inner skin is made of wood, wherein a grain of said outer skin resides with its longitudinal axis perpendicular to a grain of said inner skin;

a side; and a back;

wherein said side is tapered along a horizontal axis and is tapered along a lateral axis which is perpendicular to said horizontal axis, so as to form two distinct wedge configurations across said guitar's hollow body, and wherein said soundboard is contoured about a 12 to 15 foot radius sphere.

* * * * *